US008820393B2

(12) United States Patent
Prest et al.

(10) Patent No.: US 8,820,393 B2
(45) Date of Patent: Sep. 2, 2014

(54) BULK AMORPHOUS ALLOY SHEET FORMING PROCESSES

(71) Applicant: Apple Inc., Cupertino, CA (US)

(72) Inventors: Christopher D Prest, Cupertino, CA (US); Joseph C. Poole, Cupertino, CA (US); Joseph Stevick, Glendora, CA (US); Theodore Andrew Waniuk, Lake Forest, CA (US); Quoc Tran Pham, Anaheim, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/939,872

(22) Filed: Jul. 11, 2013

(65) Prior Publication Data

US 2013/0306201 A1 Nov. 21, 2013

Related U.S. Application Data

(62) Division of application No. 13/473,362, filed on May 16, 2012, now Pat. No. 8,485,245.

(51) Int. Cl.
*B22D 11/01* (2006.01)
*B22D 11/06* (2006.01)

(52) U.S. Cl.
CPC ..... *B22D 11/01* (2013.01); *B22D 11/06* (2013.01)
USPC ..... 164/479; 164/463; 164/81

(58) Field of Classification Search
CPC ..... B22D 11/01; B22D 11/06; B22D 11/0631
USPC ..... 164/81, 463, 479–482
See application file for complete search history.

(56) References Cited

U.S. PATENT DOCUMENTS 3,430,680 A 3/1969 Leghorn
3,841,387 A 10/1974 Martin (Continued)

FOREIGN PATENT DOCUMENTS

JP 2001-303218 10/2001

OTHER PUBLICATIONS

Watanabe et al., Innovative in-flight glass-melting technology using thermal plasmas, Pure and Applied Chemistry, vol. 82, No. 6, pp. 1337-1351, Apr. 20, 2010.

(Continued)

*Primary Examiner* — Keith Walker
*Assistant Examiner* — Kevin E Yoon
(74) *Attorney, Agent, or Firm* — Pillsbury Winthrop Shaw Pittman LLP

(57) ABSTRACT

Embodiments herein relate to a method for forming a bulk solidifying amorphous alloy sheets have different surface finish including a "fire" polish surface like that of a float glass. In one embodiment, a first molten metal alloy is poured on a second molten metal of higher density in a float chamber to form a sheet of the first molten that floats on the second molten metal and cooled to form a bulk solidifying amorphous alloy sheet. In another embodiment, a molten metal is poured on a conveyor conveying the sheet of the first molten metal on a conveyor and cooled to form a bulk solidifying amorphous alloy sheet. The cooling rate such that a time-temperature profile during the cooling does not traverse through a region bounding a crystalline region of the metal alloy in a time-temperature-transformation (TTT) diagram.

33 Claims, 4 Drawing Sheets

(56) References Cited

U.S. PATENT DOCUMENTS

| | | | | |
|---|---|---|---|---|
| 3,958,969 | A | 5/1976 | Loukes et al. | |
| 4,001,746 | A | 1/1977 | Tjernstrom et al. | |
| 4,784,680 | A | 11/1988 | Sato et al. | |
| 5,288,344 | A | 2/1994 | Peker | |
| 5,334,262 | A * | 8/1994 | Sawa et al. | 148/121 |
| 5,368,659 | A | 11/1994 | Peker | |
| 5,618,359 | A | 4/1997 | Lin | |
| 5,735,975 | A | 4/1998 | Lin | |
| 6,325,868 | B1 | 12/2001 | Kim | |
| 7,575,040 | B2 | 8/2009 | Johnson | |
| 2003/0183310 | A1 | 10/2003 | McRae | |
| 2007/0079907 | A1 | 4/2007 | Johnson | |
| 2007/0131312 | A1 | 6/2007 | Kim et al. | |
| 2008/0014447 | A1 * | 1/2008 | Muramatsu et al. | 428/426 |
| 2008/0118387 | A1 | 5/2008 | Demetriou | |
| 2010/0084052 | A1 | 4/2010 | Farmer | |
| 2010/0300148 | A1 | 12/2010 | Demetriou | |

OTHER PUBLICATIONS

Inoue et al., "Bulk amorphous alloys with high mechanical strength and good soft magnetic properties in Fe-TM-B (TM=IV-VIII group transition metal) system", Appl. Phys. Lett., vol. 71, p. 464 (1997).

Shen et al., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

* cited by examiner

PRIOR ART

PRIOR ART

Vertical section through a pool of molten glass floating on molten tin

BULK AMORPHOUS ALLOY SHEET FORMING PROCESSES

CROSS REFERENCE TO RELATED APPLICATIONS

This application is a divisional of U.S. patent application Ser. No. 13/473,362, filed on May 16, 2012, which was allowed on Mar. 21, 2013, and which will issue as U.S. Pat. No. 8,485,245 on Jul. 16, 2013. The disclosure of the prior applications is considered part of and is incorporated by reference in the disclosure of this application.

FIELD OF THE INVENTION

The present invention relates to bulk-solidifying amorphous metal alloy sheet forming processes.

BACKGROUND

Sheet metal is simply metal formed into thin and flat pieces. It is one of the fundamental forms used in metalworking, and can be cut and bent into a variety of different shapes. Thicknesses can vary significantly, although extremely thin thicknesses are considered foil or leaf, and pieces thicker than 6 mm (0.25 in) are considered plate. There are many different metals that can be made into sheet metal, such as aluminum, brass, copper, steel, tin, nickel and titanium. Conventional sheet metals and alloys deform via the formation of dislocations, i.e., plastic work. For these conventional metals, sheet metal fabrication processes can mostly be placed into two categories—forming and cutting. Forming processes are those in which the applied force causes the material to plastically deform, but not to fail. So what one would be doing is one would be introducing plastic work into the alloy as one would form it into thinner and thinner sheets. So it is cold worked. Such processes are able to bend or stretch the sheet into the desired shape. Cutting processes are those in which the applied force causes the material to fail and separate, allowing the material to be cut or removed.

On the other hand, for a bulk-solidifying amorphous alloy (also referred to as bulk metallic glass (BMG)), the sheet forming processes of the conventional crystalline metals are generally not applicable as amorphous alloys do not deform by the formation of dislocations. They fail through the formation of shear bands, which are, in general, the sort of process that are not really desirable.

A conventional method for making a BMG sheet requires casting a amorphous metal alloy at or above the melting temperature of the amorphous metal alloy, freezing the molten amorphous metal alloy in a sheet mold to form a sheet, and then using a cutting tool to remove the gate portion of the cast sheet and shape the cast sheet into the desired final geometry. However, casting requires melting and cooling of the amorphous metal alloy in a sheet mold, and this can cause uncontrolled amount of amorphicity in the BMG sheet. Furthermore, the post-processing cost for removing the gate and runner overflow and shaping the cast sheet into the desired final sheet geometry can be quite high. Therefore, new methods for making BMG sheets that overcome the above mentioned limitations of the casting process are desirable.

SUMMARY

A proposed solution according to embodiments herein for the manufacture of bulk-solidifying amorphous sheets is to use a float glass process and/or a conveyor belt-type process.

In one embodiment, a molten BMG sheet forming metal alloy at a temperature near or above a melting temperature (Tm) of the molten metal alloy is poured to form a sheet of the molten metal alloy, the sheet of the molten metal alloy is made to float on another molten metal in a float chamber; and the sheet of the molten BMG sheet forming metal alloy is cooled to form a bulk solidifying amorphous alloy sheet.

In one embodiment, a molten BMG sheet forming metal alloy at a temperature near or above a melting temperature (Tm) of the molten metal alloy is poured to form a sheet of the molten metal alloy, the sheet of the molten metal alloy is conveyed by a cooled conveyer; and the sheet of the molten BMG sheet forming metal alloy is cooled to form a bulk solidifying amorphous alloy sheet.

In one embodiment, the molten BMG forming metal alloy coming out of the reservoir/melter of the float glass process at the melting temperature Tm of the alloy would first flow over the conveyor and rapidly cool the BMG forming metal alloy in the superplastic region of the metal alloy such that time-temperature profile does not traverse through the crystalline region of the metal alloy, but the temperature of the BMG sheet continues to remain well above the glass transition temperature Tg as it exits the conveyor. Then, the BMG sheet, while still having its temperature above Tg, would enter the float chamber wherein the BMG sheet would attain excellent surface finish. Also, in the float chamber, the BMG sheet thickness could be controllably increased or deceased as explained above. Therefore, by the novel combination of the conveyor and the float chamber would allow the conveyor to rapidly cool the BMG forming metal alloy while the float chamber would be used particularly to provide an excellent surface finish to the BMG sheet.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
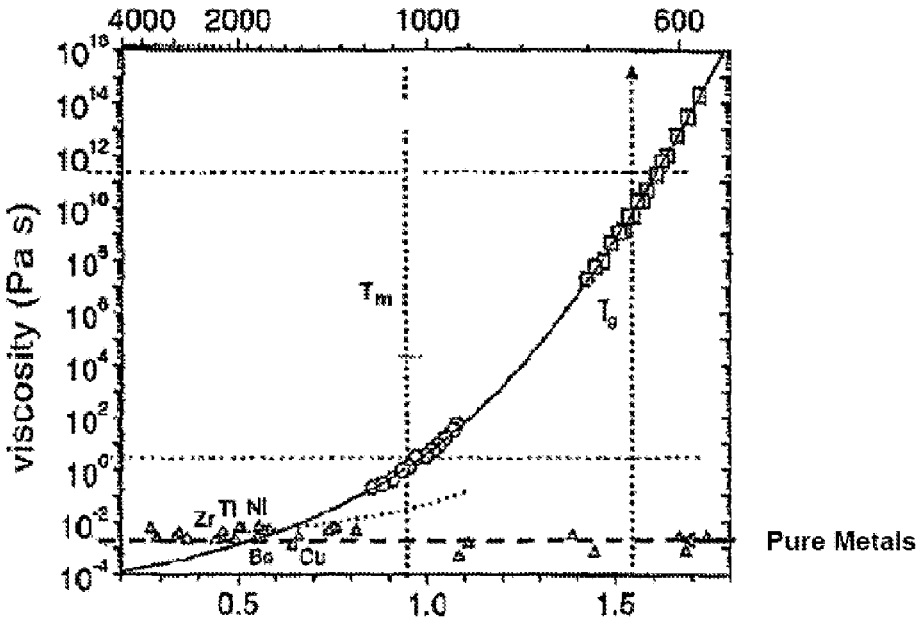
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
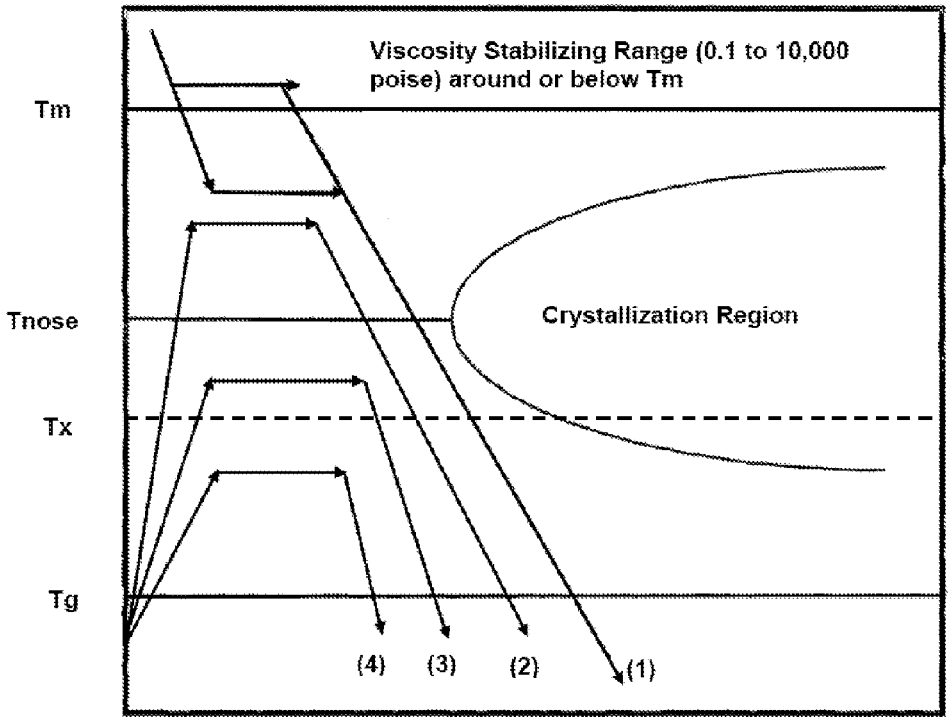
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^5$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substeantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x), s(x')\rangle$.

In the above function, s is the spin quantum number and x is the distance function within the particular system. This function is equal to unity when x=x' and decreases as the distance |x−x'| increases. Typically, it decays exponentially to zero at large distances, and the system is considered to be disordered. If, however, the correlation function decays to a constant value at large |x−x'|, then the system can be said to possess long-range order. If it decays to zero as a power of the distance, then it can be called quasi-long-range order. Note that what constitutes a large value of |x−x'| is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 5 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15 Mo14Y2C15B6. They also include the alloy systems described by Fe—Cr—Mo—(Y,Ln)—C—B, Co—Cr—Mo—Ln-C—B, Fe—Mn—Cr—Mo—(Y,Ln) —C—B,(Fe, Cr, Co)—(Mo,Mn)—(C, B)—Y, Fe—(Co,Ni)—(Zr,Nb,Ta)—(Mo,W)—B, Fe—(Al, Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Float Glass Process

Molten BMG, at approximately 1000° C., could be poured continuously from a device holding molten BMG onto a shallow bath of molten tin. The molten BMG floats on the tin, spreads out and forms a level surface. Thickness could be controlled by the speed at which solidifying BMG sheet is drawn off from the bath. After controlled cooling the BMG glass could be made as a "fire" polished product with virtually parallel surfaces.

A float plant, which operates non-stop for between 10-15 years, could make around 6000 kilometers of BMG glass a year in thicknesses of 0.1 mm to 25 mm, more preferably 0.4 mm to 15 mm and in widths up to 3 meters, for example.

Figure 3:
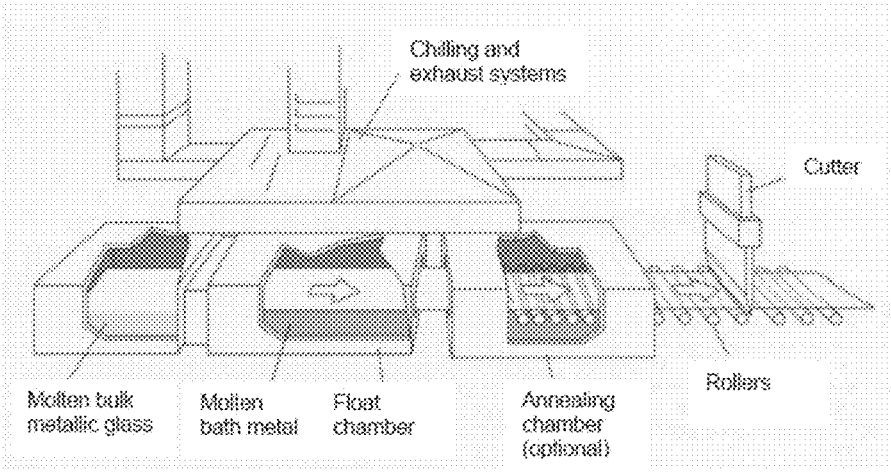
FIG. 3 provides a schematic of a float glass process modified for the manufacture of BMG sheets.

The float glass process of the embodiments herein, for example shown in FIG. 3, comprises taking a molten alloy that forms a bulk-solidifying amorphous metallic glass and pouring it onto a bath of molten metal (referred to as molten bath metal to distinguish over the molten metal alloy that forms BMG), for example, a tin bath. The majority of the BMG alloys have densities in the range of 6 to 7 grams per cc. These could be zirconium based and titanium based alloys. Titanium based alloys have densities that go from about 5 to about 7 grams per cc. Tin has a density of about 7.3 grams per cc, a melting point of 232° C., and a boiling point of 2602° C.

So by controlling the float glass process of the embodiments herein, most of the BMG alloys should float on top of the molten tin. Alternatively, one can increase the density of the liquid of the molten metal by going with specific alloys and by adding additives to tin to increase the density. Alternatively, one could use a more dense molten metal such as bismuth. Bismuth has a density of 9.78 grams per cc, a melting point of 271° C., and a boiling point of 1564° C. Bismuth has classically been considered to be the heaviest naturally occurring stable element. Bismuth compounds are used in cosmetics, medicines, and in medical procedures. Bismuth has unusually low toxicity for a heavy metal. As the toxicity of lead has become more apparent in recent years, alloy uses for bismuth metal, as a replacement for lead, have become an increasing part of bismuth's commercial importance.

The molten bath metal provides a surface for the molten amorphous alloy to flow over and it also serves to remove heat or normalize the temperature of the amorphous alloy to a specific temperature. Other molten bath materials could be what are called fusible alloys. Fusible alloys are alloys with relatively low melting temperatures and because they have such low melting temperatures, one would have a much larger range to vary the bath temperature. For example, if one used an alloy that melts at 150° C., for example, but boils at a much, much higher temperature, one could tune the temperature of the bath within a broad range. The fusible alloy of the molten bath should preferably have a higher density so that BMG alloy material would separate readily from the molten bath. One example of a fusible alloy would be a bismuth-indium-tin alloy. Bismuth would increase the density substantially over tin. Indium would also improve the density somewhat over tin. So if one would use a fused metal as the molten bath metal, which melts at approximately 60° C. and poured molten bulk amorphous alloy onto the fused metal, the molten bulk amorphous alloy would float to the top of the fused metal. In addition, the fused metal would have a relatively high thermal conductivity so one could use it to moderate the temperature of the molten bulk amorphous alloy material poured onto its surface. Since the fused metal melts at 60° C., one could even render the molten bulk amorphous alloy material poured onto it amorphous just by conduction of heat into the molten fused metal.

In one embodiment, one could use specific fusible alloys to match the densities with that of the molten BMG alloys such that the molten BMG alloys float on the molten fusible alloys. In addition, one could meet the requirements of rapid cooling for bulk amorphous alloys using a molten bath metal having a low melting temperature.

A fusible alloy is a metal alloy capable of being easily fused, i.e. easily meltable, at relatively low temperatures. Fusible alloys are commonly, not necessarily, eutectic alloys. The term "fusible alloy" is used to describe alloys with a melting point below that of tin, e.g., 225° C., preferably below 150° C. Fusible alloys in this sense are used for solder. From practical view, low melting alloys can be divided up into: mercury-containing alloys; only alkali metal-containing alloys; gallium-containing alloys (but neither alkali metal nor mercury); only bismuth, lead, tin, cadmium, zinc, indium and sometimes thallium-containing alloys; and some reasonably well known fusible alloys are Wood's metal, Field's metal, Rose metal, Galinstan, and NaK.

Melted fusible alloys can be used as coolants as they are stable under heating and can give much higher thermal conductivity than most other coolants; particularly with alloys made with a high thermal conductivity metal such as indium or sodium. Some examples of fusible alloys are shown in Table 2.

The molten bath metal could be above, at, or below the melting point of the bulk amorphous alloy. In one embodiment, the molten bath temperature could be below the melting point of the bulk amorphous alloy and, preferably, below the glass transition of the bulk amorphous alloy so such that the alloy poured on top of the molten bath metal would be cooled to the point where it would be a fully amorphous solid and even more ideally it would have a melting temperature much lower than the glass transition such that the bulk amorphous alloy poured onto the molten bath metal would be cooled very rapidly and rendered amorphous easily. Preferably, the molten bulk amorphous alloy has to be cooled faster than a certain rate to generate as shown by trajectory (1) in FIG. 2, for example, to obtain a fully amorphous solid. That is why one would prefer using fusible alloys of melting temperatures at or near room temperature because these would provide a much faster cooling rate for the amorphous alloy poured on top of them.

In one embodiment, the molten BMG exiting the molten BMG melter/reservoir (shown as the first device on the left of FIG. 3) could be made to run through a set of rollers before entering the float chamber in FIG. 3. Other variations on this process include: pouring the amorphous alloy through rollers before it enters the molten bath, using more than one molten baths at different temperature, using rollers between molten baths at different temperature, using a bath filled with mercury as the molten bath metal, cooling the molten bath metal using cooling tubes and/or heat exchangers within and outside the float chamber, injecting inert gas relative to the molten BMG in the BMG melter/reservoir, the float chamber or any other section of the apparatus of the float process, keeping the float chamber under vacuum, selectively heating certain regions of the float chamber, particularly near where the

TABLE 2

Low melting alloys and metallic elements

| Composition in weight-percent | ° C. | eutectic? | Name or remark |
|---|---|---|---|
| Cs 73.71, K 22.14, Na 4.14 | −78.2 | yes | |
| Hg 91.5, Ti 8.5 | −58 | yes | used in thermometers |
| Hg 100 | −38.8 | (yes) | |
| Cs 77.0, K 23.0 | −37.5 | | |
| K 76.7, Na 23.3 | −12.7 | yes | |
| K 78.0, Na 22.0 | −11 | no | NaK |
| Ga 61, In 25, Sn 13, Zn 1 | 8.5 | yes | |
| Ga 62.5, In 21.5, Sn 16.0 | 10.7 | yes | |
| Ga 69.8, In 17.6, Sn 12.5 | 10.8 | no | |
| Ga 68.5, In 21.5, Sn 10 | 11 | no | Galinstan |
| Ga 75.5, In 24.5 | 15.7 | yes | |
| Cs 100 | 28.6 | (yes) | |
| Ga 100 | 29.8 | (yes) | |
| Bi 40.3, Pb 22.2, In 17.2, Sn 10.7, Cd 8.1, Ti 1.1 | 41.5 | yes | |
| Bi 40.63, Pb 22.1, In 18.1, Sn 10.65, Cd 8.2 | 46.5 | | |
| Bi 32.5, In 51.0, Sn 16.5 | 60.5 | yes | Field's metal |
| Bi 49.5, Pb 27.3, Sn 13.1, Cd 10.1 | 70.9 | yes | Lipowitz's alloy |
| Bi 50.0, Pb 25.0, Sn 12.5, Cd 12.5 | 71 | no | Wood's metal |
| In 66.3, Bi 33.7 | 72 | yes | |
| Bi 50, Lead 30, Sn 20, Impurities | 92 | no | Onion's Fusible Alloy |
| Bi 52.5, Pb 32.0, Sn 15.5 | 95 | yes | |
| Bi 50.0, Pb 31.2, Sn 18.8 | 97 | no | Newton's metal |
| Bi 50.0, Pb 28.0, Sn 22.0 | 109 | no | Rose's metal |
| Bi 56.5, Pb 43.5 | 125 | yes | |
| Bi 58, Sn 42 | 139 | yes | |
| In 100 | 157 | (yes) | |
| Sn 62.3, Pb 37.7 | 183 | yes | |
| Sn 63.0, Pb 37.0 | 183 | no | Eutectic solder |
| Sn 91.0, Zn 9.0 | 198 | yes | |
| Sn 92.0, Zn 8.0 | 199 | no | Tin foil |
| Bi 100 | 271.5 | (yes) | |
| Zn 100 | 419.5 | (yes) | |

molten BMG enters the float chamber, for example, using IR lamps, and annealing the BMG sheet after exiting the float chamber as shown in FIG. 3.

Some of the different stages of the BMG float glass process of the embodiments here are the following:

Stage 1: Melting BMG Forming Metal Alloy Feedstock

The BMG forming metal alloy feedstock could be in any form, e.g., powder, pellets, rods, ingots, etc. The feedstock is heated and melted. One could heat and melt the feedstock in the molten BMG melter/reservoir shown in FIG. 3 by continuously adding feedstock to the molten BMG melter/reservoir or externally in a crucible and pour the molten alloy into the BMG melter/reservoir shown in FIG. 3. One could also embed heating cartridges (resistive heaters, for example) to warm the BMG melter/reservoir. Another option would be to use induction heating using induction heaters and by making the BMG melter/reservoir transparent to electromagnetic waves for induction heating, e.g., by using a ceramic melter/reservoir.

Induction heating is a non-contact heating process. It uses high frequency electricity to heat materials that are electrically conductive. Since it is non-contact, the heating process does not contaminate the material being heated. It is also very efficient since the heat is actually generated inside the BMG feedstock. This can be contrasted with other heating methods where heat is generated in a flame or heating element, which is then applied to the BMG feedstock. For these reasons induction heating lends itself to heating the feedstock of BMG as this feedstock generally comprise reactive metals.

In one embodiment of melting the feedstock include in-flight heating using, for example, induction that could momentarily raise the temperature of the BMG forming metal alloy in granular or powder form to several thousand degrees Centigrade. This method enables the instant completion of the melting process, which usually consumes a lot of energy. Specifically, granular or powder materials with pre-adjusted composition of the BMG forming metal alloy (e.g., the granular or powder material could contain elements or compounds that form the BMG forming metal alloy) could be injected into the reservoir/melter from above and the materials pass through between the induction heating coils to be instantly melted by induction heating. By adopting in-flight melting to charge reservoir/melter of the BMG sheet manufacturing float glass process, one should be able to substantially reduce $CO_2$ emissions from BMG sheet manufacturing. Also, one could downsize the reservoir/melter substantially.

Stage 2: Float Chamber

Glass from the reservoir/melter flows over a spout on to the mirror-like surface of the molten bath metal, entering at about the melting temperature Tm of the BMG forming metal alloy and leaving the float chamber as a solid ribbon at a temperature below Tg, with the cooling profile of temperature of the BMG forming metal alloy in the float chamber not traversing through the crystalline region of the TTT diagram of the BMG forming metal alloys.

Stage 3: Coating

Coatings that make profound changes in optical or electrical properties can be applied by advanced high temperature technology during the cooling of the BMG forming metal alloy in the float chamber. On-line chemical vapor deposition (CVD) of coatings can be used to lay down a variety of coatings, less than a micron thick, to reflect visible and infrared wavelengths, for instance. Multiple coatings can be deposited in the few seconds available as the BMG sheets flows beneath the coaters.

Stage 4: Annealing and/or Superplastic Forming (Optional)

Despite the tranquility during the BMG sheet forming process using the float glass process, some stresses could develop in the BMG sheet. To relieve these stresses, the BMG sheet could undergo heat-treatment such that the heat treatment only occurs in the superplastic region of the BMG forming metal alloy without of the temperature of the BMG sheet traversing through the crystalline region of the TTT diagram of the BMG forming metal alloys, such as the time-temperature trajectories shown as (2) to (4) in FIG. 2. Also, while the temperature of the BMG sheet is in the superplastic region, one could do superplastic forming on the BMG sheet to shape the BMG sheet or form micro- and/or nano-replications on the BMG sheet. Temperatures are closely controlled both along and across the BMG sheet. One could monitor the stress levels in the BMG sheet and automatically feed back stress levels in the BMG sheet to control the temperatures during annealing and/or superplastic forming.

Stage 5: Inspection

The float glass process of the embodiments herein could make perfectly flat, flaw-free BMG sheets. But to ensure the highest quality, inspection could take place at every stage. Automated on-line inspection could be used to reveal process faults upstream and corrected, and it enables computers downstream to steer cutters round flaws. Inspection technology could allow more than 100 million measurements a second to be made across the BMG sheet, locating flaws the unaided eye would be unable to see.

Stage 6: Marking and/or Cutting the BMG sheet

The BMG sheet could be marked and cut to size. In one embodiment, the certain regions of the BMG sheet could be intentionally heated using a laser and slowly cooled to allow certain precise regions to be crystallized while leaving the rest of the BMG sheet as an amorphous sheet. A diamond wheel could then be used to cut the BMG sheet with the cut traversing through the precise regions that have been crystallized while, preferably, preventing the amorphous regions of the BMG sheet from getting crystallized due to the heat generated during cutting.

Controlling Thickness of the BMG Sheet During the Float Glass Process

If molten glass is poured onto a bath of clean molten tin, for example, the glass will spread out in the same way that oil will spread out if poured onto a bath of water. In this situation, gravity and surface tension will result in the top and bottom surfaces of the glass becoming approximately flat and parallel.

The molten glass does not spread out indefinitely over the surface of the molten tin. Despite the influence of gravity, it is restrained by surface tension effects between the glass and the tin. The resulting equilibrium between the gravity and the surface tensions defines the equilibrium thickness of the molten glass (T). The resulting pool of molten glass has the shape shown FIG. 4.

Figure 4:
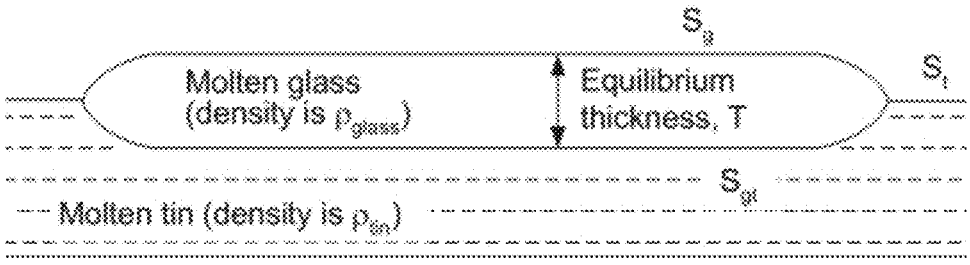
FIG. 4 provides a schematic to explain the physics underlying the concept of equilibrium thickness of a float glass.

The equilibrium thickness (T) is given by the relation:

$$T^2 = (S_g + S_{gt} + S_t) \times \frac{2\rho_t}{g\rho_g(\rho_t - \rho_g)}$$

where $S_g$, $S_{gt}$, and $S_t$ are the values of surface tension at the three interfaces shown in the diagram of FIG. 4.

For standard soda-lime-silica glass under a protective atmosphere and on clean tin the equilibrium thickness is approximately 7 mm as explained in Charnock, H. *Physics Bulletin* 1970, 21, 153-156). Similarly, a BMG sheet of the embodiments herein would have an equilibrium thickness depending on the properties of the BMG forming metal alloy and the molten bath metal.

For thin sheets, the exit conveyor speed can be increased to draw the BMG sheet down to thinner thicknesses. This drawing down will also result in a decrease in the BMG sheet width and to prevent unacceptable sheet width decreases edge rolls could be used. Edge rolls grip the outer top edge of the BMG sheet and not only reduce decrease in width but also help to reduce the thickness even further.

For thick sheets, the spread of the molten BMG forming metal alloy could be limited by using non-wetted longitudinal guides. The BMG forming metal alloy temperature could be adjusted to allow the spread to remain uniform and could be reduced to close to or below Tg in the BMG sheet until it can leave the guides without changing dimensions.

In another embodiment one could have a conveyor which is predominately cold and could be actively cooled. The molten BMG forming metal alloy material could be poured onto one end of the conveyor and when it would hit the conveyor would have its heat removed via the conveyor and at the same time as it is conveyed to the other end of the conveyor where it is removed at the edge. The conveyor type system could also have patterns or features, grooves for example, that the molten material fills in and thereby creating strips with the surface texture. One could have the conveyor run with a specific programmed velocity profile such that the molten material will take on different thicknesses depending on the velocity of the conveyor. So for example, if one would start out with the conveyor running at a very slow speed, the material that pours onto its surface would have a first thickness. As one increases the speed while continuing to pour the material, it begins to get thinner and thinner so one would have a varying thickness profile to that poured material, which could be strips or plates, for example. If one were to run the conveyor and oscillate and change its direction, one pour material built up on top of previously poured material to create a thicker layer, which is cooled through the cooled conveyor belt.

In one another embodiment, one could use a conveyor located between the reservoir/melter and float chamber in FIG. 3. In this embodiment, the molten BMG forming metal alloy coming out of the reservoir/melter at the melting temperature Tm of the alloy would first flow over the conveyor and rapidly cool the BMG forming metal alloy in the superplastic region of FIG. 2 such that time-temperature profile does not traverse through the crystalline region of the metal alloy in FIG. 2, but the temperature of the BMG sheet continues to remain well above Tg as it exits the conveyor. Then, the BMG sheet, while still having its temperature above Tg, would enter the float chamber wherein the BMG sheet would attain excellent surface finish. Also, in the float chamber, the BMG sheet thickness could be controllably increased or deceased as explained above. Therefore, by the novel combination of the conveyor and the float chamber would allow the conveyor to rapidly cool the BMG forming metal alloy while the float chamber would be used particularly to provide an excellent surface finish to the BMG sheet.

In one embodiment, the BMG sheet forming process could be run in a controlled environment such that the whole or part of the system for the BMG sheet forming could be under vacuum or inert atmosphere. While a controlled environment might not be needed for BMG sheet made of precious metal alloy, a controlled environment would be desirable for forming BMG sheet made of Zr based and similar alloys.

In one embodiment, one could have a molten bath with two non-mixable molten metals, one having higher density than BMG, and one having a lower density than BMG, with the BMG sheet sandwiched between the two molten metals. The molten metals could protect the BMG sheet from oxidation.

In yet another embodiment, one could add rollers at the junction between the two molten metal to control the BMG sheet thickness.

What is claimed:

1. A method comprising:

pouring a first molten metal comprising a metal alloy at a temperature near or above a melting temperature (Tm) of the first molten metal so as to form a sheet of the first molten metal, wherein the first molten metal has a composition that forms a bulk solidifying amorphous alloy, at a cooling rate of 1000 degree C/s or less, cooling and moving at the same time the sheet of the first molten metal to form a bulk solidifying amorphous alloy sheet, wherein the cooling is at a cooling rate such that a time-temperature profile during the cooling does not traverse through a region bounding a crystalline region of the metal alloy in a time-temperature-transformation (TTT) diagram, further comprising selectively heating a region of the bulk solidifying amorphous alloy sheet and crystallizing the region.

2. The method of claim 1, further comprising applying a coating on the bulk solidifying amorphous alloy sheet.

3. The method of claim 2, wherein the coating reflects visible and infrared wavelengths.

4. The method of claim 1, further comprising annealing the bulk solidifying amorphous alloy sheet to a temperature in a superplastic region of the bulk solidifying amorphous alloy.

5. The method of claim 1, wherein the bulk solidifying amorphous alloy comprises zirconium, titanium, platinum, palladium, gold, silver, copper, iron, nickel, aluminum, molybdenum, or a combination thereof.

6. The method of claim 1, wherein moving the sheet of the first molten metal comprises moving the sheet of the first molten metal on or through a bath of at least one molten bath metal.

7. The method of claim 6, wherein the at least one molten bath metal is selected from a group consisting of tin, lead, bismuth, indium, and combination thereof.

8. The method of claim 6, wherein the at least one molten bath metal is selected from a group consisting of an eutectic alloys, mercury-containing alloys, alkali metal-containing alloys, gallium-containing alloys, bismuth, lead, tin, cadmium, zinc, indium and thallium-containing alloys.

9. The method of claim 6, wherein the bath of the at least one molten bath metal is configured to cool the sheet of the first molton metal at a rate sufficient to solidify the sheet into the sheet of bulk solidifying amorphous alloy.

10. The method of claim 6, wherein a melting point of the at least one molten bath metal is lower than a melting point of the first molten metal.

11. The method of claim 6, wherein a melting point of the at least one molten bath metal is lower than a glass transition temperature of the first molten metal.

12. The method of claim 1, wherein moving the sheet of the first molten metal comprises moving the sheet of the first molten metal on a conveyor.

13. The method of claim 12, wherein the conveyor is configured to convey and cool the sheet of the first molten metal at the same time.

14. The method of claim 12, wherein the conveyor has a surface texture configured to be filled by the first molten metal.

15. The method of claim 12, wherein the conveyor is configured to stretch the sheet of the first molten metal so as to adjust a thickness of the bulk solidifying amorphous alloy sheet.

16. The method of claim 12, wherein the conveyor is configured to oscillate.

17. The method of claim 1, wherein the first molten metal comprises a zirconium or iron based alloy.

18. The method of claim 1, further comprising floating the sheet of the first molten metal on a second molten metal in a float chamber.

19. The method of claim 18, wherein the second molten metal comprises tin and/or bismuth.

20. The method of claim 18, wherein the second molten metal comprises a fusible alloy having a melting point below the melting point of zinc or tin.

21. The method of claim 18, wherein the float chamber comprises an integrated cooling channel within the float chamber, wherein the cooling channel is configured to allow a coolant to flow through the cooling channel.

22. The method of claim 1, further comprising maintaining the first molten metal in a melter/reservoir at the temperature near or above the melting temperature (Tm) of the first molten metal.

23. The method of claim 22, wherein the maintaining the first molten metal in the melter/reservoir at the temperature near or above Tm of the first molten metal comprises induction heating the first molten metal.

24. The method of claim 23, wherein the melter/reservoir is substantially electromagnetically transparent.

25. The method of claim 22, further comprising melting a solid feedstock of the first molten metal using in-flight heating of the solid feedstock to form the first molten metal in-flight prior to the melter/reservoir.

26. The method of claim 1, wherein the method is carried out in an apparatus comprising:

a conveyor configured to receive the sheet of the first molten metal, wherein the conveyor is configured to convey the sheet of the first molten metal thereon, wherein the conveyor is configured to cool the sheet of the first molten metal to form the bulk solidifying amorphous alloy sheet.

27. The method of claim 1, wherein the method is carried out in an apparatus comprising:

a chamber configured to contain a bath of a molten bath metal and to maintain a temperature of the bath so that the molten bath metal remains molten;

wherein the chamber is configured to receive the sheet of the first molten metal, in contact with and movable relative to the bath;

wherein the apparatus is configured to cool the sheet of the first molten metal at a rate sufficient to solidify the sheet into the sheet of bulk solidifying amorphous alloy.

28. The method of claim 27, further comprising rollers.

29. The method of claim 27, further comprising cooling tubes, heat exchangers, or a combination thereof.

30. The method of claim 27, wherein the apparatus is configured to maintain a vacuum or an inert gas atmosphere in the chamber.

31. The method of claim 27, wherein the apparatus is configured to anneal the sheet of bulk solidifying amorphous alloy.

32. The method of claim 27, wherein the sheet of the molten bulk solidifying amorphous alloy floats on the bath.

33. The method of claim 27, wherein the apparatus is configured to convey the sheet of the molten bulk solidifying amorphous alloy on or through the bath.

* * * * *